United States Patent [19]

Silvestri, Jr.

[11] Patent Number: 4,840,537

[45] Date of Patent: Jun. 20, 1989

[54] AXIAL FLOW STEAM TURBINE

[75] Inventor: George J. Silvestri, Jr., Winter Park, Fla.

[73] Assignee: Westinghouse Electric Corp., Pittsburgh, Pa.

[21] Appl. No.: 257,909

[22] Filed: Oct. 14, 1988

[51] Int. Cl.[4] ..... F01D 1/02

[52] U.S. Cl. ..... 415/202; 415/136; 29/156.8 R; 29/447

[58] Field of Search ..... 415/108, 202, 134, 136, 415/138, 139; 29/156.8 R, 157 C, 447

[56] References Cited

U.S. PATENT DOCUMENTS

| | | | |
|---|---|---|---|
| 1,154,777 | 9/1915 | Kieser | 415/138 |
| 2,527,445 | 10/1950 | Pentheny | 415/138 |
| 4,097,188 | 6/1978 | Forster | 415/202 |
| 4,362,464 | 12/1982 | Stock | 415/136 |
| 4,702,673 | 10/1987 | Hansen et al. | 29/156.8 R |
| 4,723,578 | 2/1988 | Mordarski et al. | 29/447 |
| 4,762,028 | 8/1988 | Regan | 294/447 |

FOREIGN PATENT DOCUMENTS

| | | | |
|---|---|---|---|
| 85520 | 9/1956 | Netherlands | 415/202 |

OTHER PUBLICATIONS

Design of 321-mw Cross-Compound Steam Turbine-River Rouge Unit No. 3 by C. D. Wilson, 1958.

Expansion with 850 MW Fossil Fired Units in Peaking Service by Byron G. Dixon, 1978.

*Primary Examiner*—Robert E. Garrett

*Assistant Examiner*—John T. Kwon

*Attorney, Agent, or Firm*—K. Bach

[57] ABSTRACT

An axial flow steam turbine has a nozzle ring circumferentially about the rotor thereof and inner and outer sections forming the ring with confronting channels therein, and a plurality of nozzle chambers communicating with the spacing between the ring sections. A plurality of nozzle blocks having radially outwardly and inwardly extending flanges are positioned in the inlet nozzle such that the same are retained therein under compressive forces exerted by the nozzle ring sections. A method for forming the same is also provided.

9 Claims, 2 Drawing Sheets

AXIAL FLOW STEAM TURBINE

BACKGROUND OF THE INVENTION

This invention relates to an axial flow steam turbine, and more particularly to such a turbine having improved nozzle blocks for passage of motive steam from a steam inlet to the initial expansion stage of the turbine, and a method for improving the fatigue strength thereof.

Axial flow steam turbines, for the production of electricity generally contain a rotor that is disposed in a casing, and preferably a pair of spaced casings, an outer casing, and an inner casing containing the rotor. This pair of casings enables reduction of thermal gradients and pressure differences across the individual casings so that each casing is free to expand individually. Nozzle chambers are generally disposed within the inner casing which change the direction of inlet steam from a radial to an axial direction and then through nozzle blocks to the blades and vanes of the turbine.

In axial flow steam turbine operations, incoming steam is charged through inlet nozzles to a nozzle ring that contains a plurality of nozzle blocks. These nozzle blocks contain vanes which direct the steam to the control stage or first stage of expansion of the steam. The trailing edges of the nozzles suffer from breaking off or cracking, due to the cycling that is occurring in the structure. Where the steam is exiting at a high velocity, the nozzles tend to crack and fragment, with losses associated therewith. This problem arises because a pressure difference occurs on each side of the nozzle. The problem is exaggerated, however, because hard particles, such as steel flakes, sometimes enter with the steam and increase the cracking problem. The use of highly corrosive-resistent coatings to protect the nozzle vanes is not feasible because of flaking off of such coatings due to different coefficients of expansion. Also, such coatings cannot be used because they reduce the fatigue strength of the component. In order to alleviate the cracking problem, the trailing edges of the nozzle are often made thicker than is necessary or desirable.

One source of the cracking problems relative to the nozzles is the fact that the nozzle is under tension during operation of the turbine. Due to its installation and design, the nozzle carries some of the structural load. If the nozzles were not under tension, the fatigue strength would increase and the trailing edges could be thinned down to a more efficient design.

It is an object of the present invention to provide an axial flow steam turbine wherein the nozzles at the nozzle chamber are under compression rather than tension during operation so as to enhance the fatigue strength of the nozzles.

BRIEF SUMMARY OF THE INVENTION

With this obejct in view, the present invention is an axial flow steam turbine having a rotor, contained in a casing, with preferably an inner casing disposed between the rotor and the casing. An inlet nozzle ring is provided, circumferentially about the rotor within the inner casing, that includes radially spaced inner and outer sections, these sections having confronting channels therein, and a plurality of nozzle chambers that communicate with the spacing between the nozzle sections. A plurality of nozzle blocks are provided which have radially inwardly and outwardly extending flanges thereon, and the flanges are positioned in the channels of the inlet nozzle ring sections and are containing therein under compressive forces exerted by the nozzle ring sections.

A method of improving the fatigue strength of control stage nozzle comprises inserting the nozzle blocks between the spaced inlet nozzle sections and then retaining them therebetween under compressive force.

BRIEF DESCRIPTION OF THE DRAWINGS

The invention will become more readily apparent from the following description of a preferred embodiment thereof, shown by way of example only, in the accompanying drawings, wherein.

DESCRIPTION OF THE PREFERRED EMBODIMENT

Figure 1:
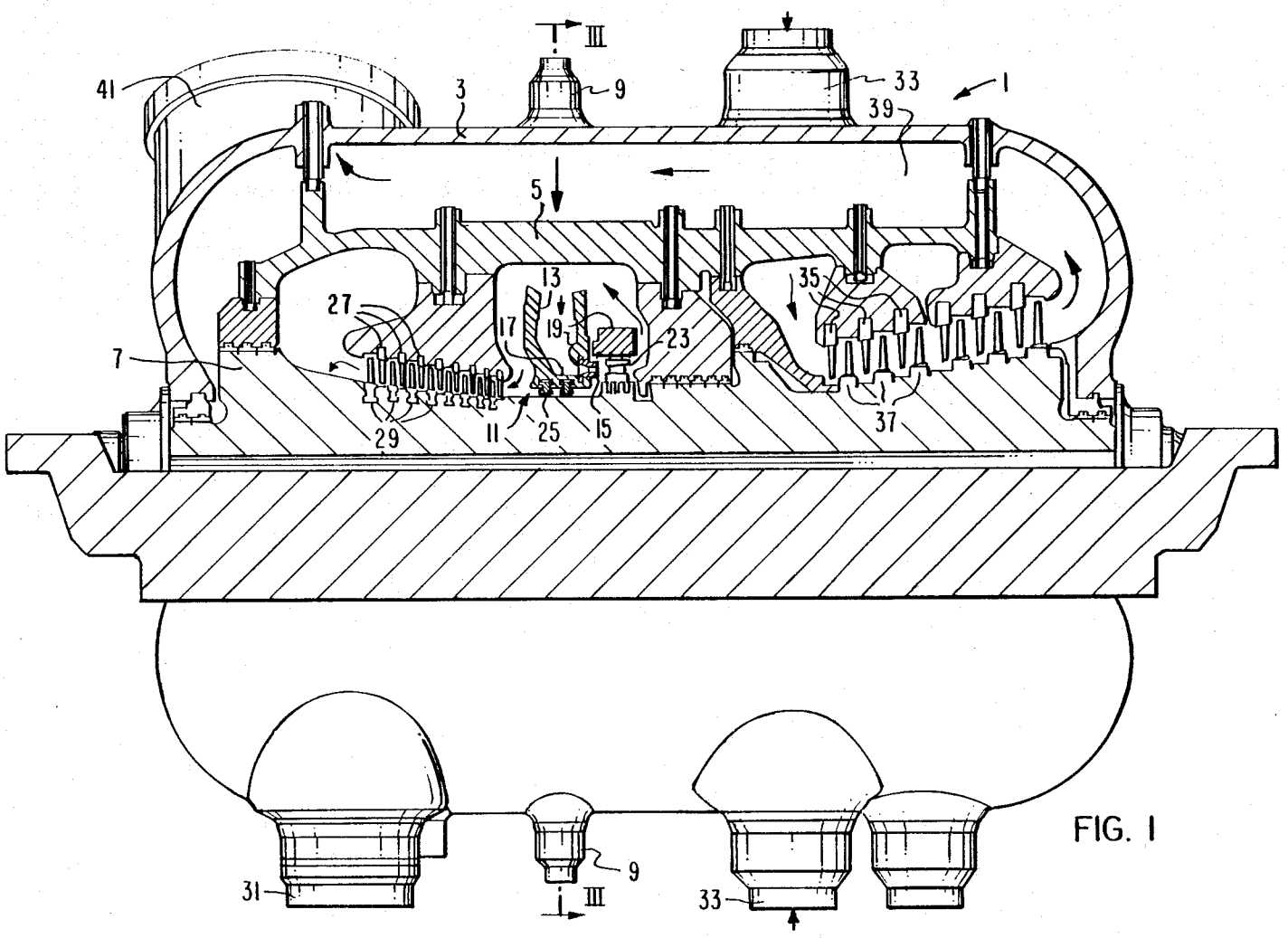
FIG. 1 is a partial sectional view of an axial flow steam turbine constructed in accordance with the present invention.
Figure 2:
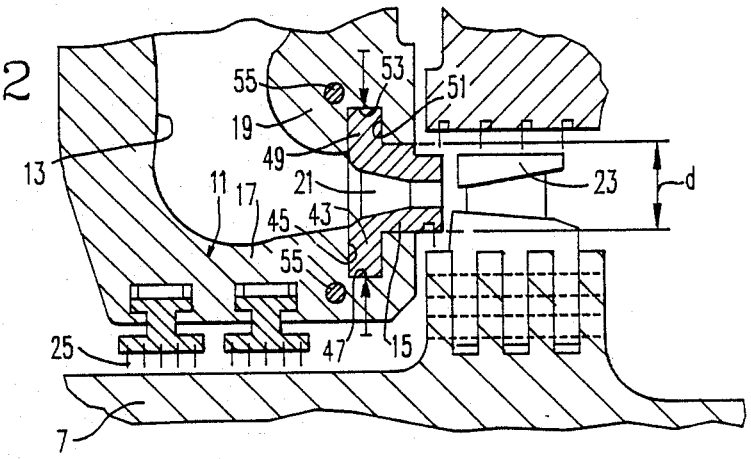
FIG. 2 is an enlarged cross-sectional view similar to FIG. 1 showing the area of a nozzle chamber, nozzle block and control stage of the axial flow steam turbine.
Figure 3:
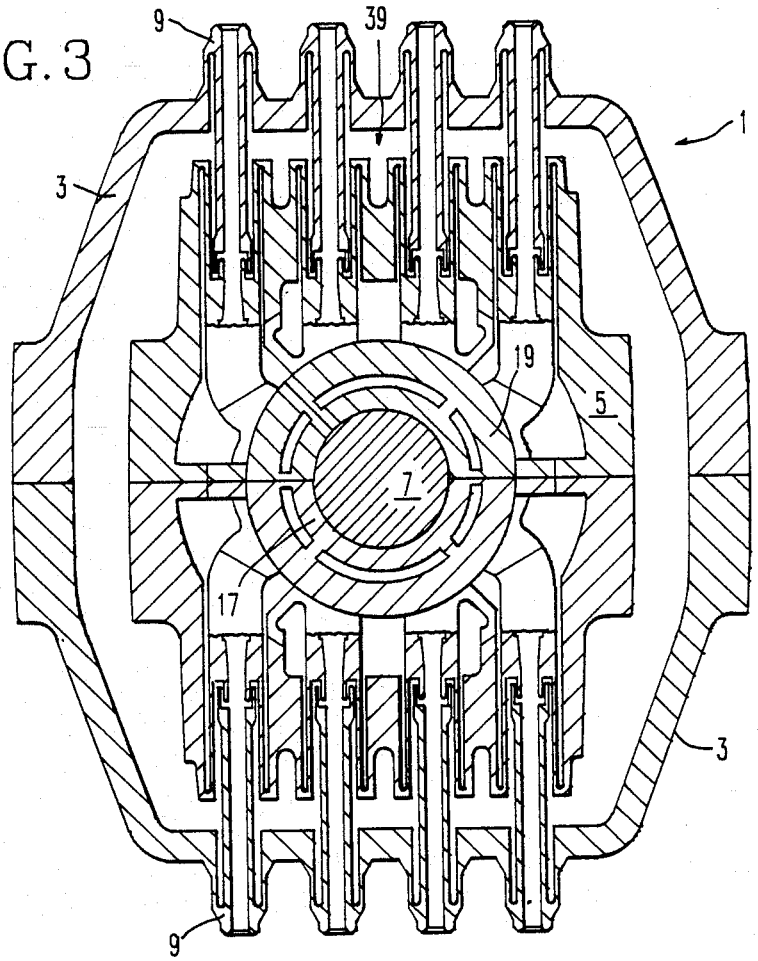
FIG. 3 is a cross-sectional view taken along lines III—III of FIG. 1.

Referring now to the drawings, FIG. 1 illustrates a partial sectional view of an axial flow steam turbine 1, having an outer casing or cylinder 3, and an inner casing or cylinder 5, which contain a rotor 7. In some embodiments of turbines, only the outer cylinder or casing 3 is provided and the present invention usable therein. The following description however will refer to the preferred embodiment wherein an inner casing 5 is provided between the outer casing 3 and the rotor 7. A pluality of inlet nozzles 9 are provided which communicate with an inlet nozzle ring 11. The nozzle ring 11 is circumferentially disposed about the rotor 7 and includes a plurality of inlet nozzle chambers 13 that communicate with the inlet nozzles 9, and terminate, in an axial direction relative to rotor 7, as nozzle blocks 15, in radially spaced inner and outer sections 17, 19 of the nozzle ring. The nozzle chambers 13, generally about 4 to 6 or more of which are provided, manifold the steam charged through inlet nozzles 9 to nozzle blocks 15 through which the steam is initially expanded. Each of the nozzle blocks 15 includes a plurality of stationary vanes 21 (FIG. 2). The nozzle blocks 15 with vanes 21 control the expansion of the steam and impart the desired directional flow to the steam prior to its entry and subsequent expansion through control stage rotatable blades 23 which are connected to the rotor 7. Labyrinth seals 25 are provided between the nozzle ring 11 and rotor 7 to minimize leakage therebetween.

As an example of flow of steam through the turbine 1, the steam flows from inlet nozzle 9 to nozzle block 15, and through nozzle block 15 to control stage rotatable blades 23. As indicated by the arrows (FIG. 1), the steam flow is then reversed and sent through a series of alternating stationary nozzle vanes 27 and rotatable turbine blades 29 so as to impart motion to the rotor 7. The steam then exits the casing through outlet conduit 31 to be reheated and, after reheating is returned through inlet conduits 33, with the reheated steam flowing through a further series of alternating stationary nozzle vanes 35 and rotatable blades 37, to induce further motion to the rotor 7. The steam is then passed through the spacing 39 between the outer casing 3 and inner casing 5, as a cooling medium, and is finally discharged from the turbine through an exhaust conduit 41.

In accordance with the present invention, the nozzle chamber 13 is designed to provide for a nozzle block 15 that is under compression. The nozzle block 15 has a radially inwardly extending flange 43 which is adapted to seat in a channel 45 formed in the inner section 17 of the nozzle ring 11, with a first base 47 in the nozzle ring 11 at the bottom of channel 45. A radillay outwardly extending flange 49 on nozzle block 15 is adapted to seat in a channel 51 formed in the outer section 19 of the nozzle ring 11, with a second base 53 in the nozzle ring 11 at the bottom of channel 51. The channels 45 and 51 and first and second bases 47 and 53 confront each other. The nozzle block 15 is of a radial width d which is slightly larger than the distance between the inner and outer sections 17 and 19 of the nozzle ring 11, such that those sections must be forced apart a distance greater than d to position the nozzle block 15 therebetween. Upon release of the force spreading apart radially spaced sections 17 and 19, the nozzle block 15 is contained therein under compressive forces exerted by the nozzle ring sections 17 and 19, as indicated by the arrows in FIG. 2. The compressive forces desired are effected by contact of the first base 47 at the bottom of channel 45 in the inner section 17 of nozzle ring 11 against the inwardly extending flange 43 and contact of the second base 53 at the bottom of channel 51 in the outer section 19 of the nozzle ring 11 against the outwardly extending flange 49. The forces exerted thereby are then transmitted throughout the nozzle block 15 as compressive forces.

In order to insert the nozzles, the radially spaced inner and outer sections 17 and 19 must be radially displaced relative to each other, such as by being spread apart, a sufficient distance to enable the nozzle flanges 43 and 49 to enter confronting channels 45 and 51. Lugs 55 may be provided on each of radially spaced inner and outer sections 17 and 19, and the sections pulled apart by forces acting opposite the arrows shown in FIG. 2, by engagement of said lugs, so that the nozzle can be slipped axially into position. Once the pulling force is released, the sections 17 and 19 of the nozzle ring 11 put a compressive force on the nozzle blocks 15.

In an alternative assembly of the nozzle blocks, such that they are under compressive forces from the nozzle ring, the radially spaced inner and outer sections 17 and 19 would be heated and the nozzle block 15 cooled. The thermal effects on the nozzle ring sections radially displaces the same relative to each other and the nozzle blocks would compact such that the nozzle block could be inserted and, upon coming to a common temperature, the nozzle block 15 would be under compressive forces from the radially spaced inner and outer sections 17 and 19.

After insertion of the nozzle block 15 under compressive force, when the pressure load is in effect, there is a tension force. The nozzle is converted from a design which was once under high tension to a design which is now low compression or low tension. The fatigue strength increases as the result of this reduction or elimination of tension. While the construction does put more stress on the nozzle chamber because it must now support the pressure difference, this stress is countered by thickening the nozzle chamber design and is justified by the overriding improvement with regard to the nozzle efficiency.

The present invention provides a compressive force on the nozzle rather than tension when the turbine is at load. Therefore, the fatigue strength is enhanced and a thinner more efficient trailing edge can be used on the nozzle. This construction will also allow for use of corrosion resistant coatings on the nozzle since there is no longer the same kind of fatigue environment that prevails in conventional designs.

What is claimed is:

1. An axial flow steam turbine comprising:

a rotor;

a casing;

an inlet nozzle ring disposed circumferentially about said rotor within said casing, said inlet nozzle ring including radially spaced inner and outer sections, said sections having confronting channels across said space, and a plurality of nozzle chambers communicating with said space; and a plurality of nozzle blocks having radially inwardly and outwardly extending flanges, said flanges positioned in said confronting channels of said inlet nozzle ring and contained therein under compressive forces exerted by said nozzle ring sections.

2. An axial flow steam turbine as defined in claim 1 wherein said casing comprises an outer casing, and an inner casing is disposed between said rotor and said outer casing, and said inlet nozzle ring is disposed about said rotor within said inner casing.

3. The axial flow steam turbine as defined in claim1 wherein a first base in said inlet nozzle ring is provided at the bottom of the channel in said radially spaced inner section and a second base in said inlet nozzle ring is provided at the bottom of the channel in said radially spaced outer section, which base exert compressive forces on the radially inwardly extending flange and radially outwardly extending flange respectively of said nozzle blocks.

4. The axial flow steam turbine as defined in claim 3 wherein a plurality of stationary vanes are included in each of the nozzle blocks.

5. An axial flow steam turbine as defined in claim 1 wherein lugs are provided on each of said radially spaced inner and outer sections of said nozzle ring, whereby said sections can be pulled apart for insertion of the nozzle blocks by engagement of said lugs.

6. A method of improving the fatigue strength of control stage nozzles of an axial flow steam turbine, wherein said turbine has a rotor, a casing, an inlet nozzle ring disposed circumferentially about the rotor within the casing, the inlet nozzle ring including radially spaced inner and outer sections with the sections having confronting channels across said space, the channels having a base at the bottom thereof, and plurality of nozzle chambers communicating with the space, comprising:

providing nozzle blocks having radially inwardly and outwardly extending flanges, the flanges having a diameter greater than the spacing between the bases of said confronting channels;

radially displacing said nozzle ring inner and outer sections relative to each other and inserting said nozzle blocks therebetween with the flanges thereof in said confronting channels; and releasing said nozzle ring inner and outer sections such that the bases of said channels contact said flanges and contain the nozzle block therein under compressive forces.

7. The method of improving the fatigue strength of control stage nozzles of an axial flow steam turbine as defined in claim 6 wherein said nozzle ring inner and outer sections are radially displaced relative to each other by pulling apart said sections.

8. The method of improving the fatigue strength of control stage nozzles of an axial flow steam turbine as defined in claim 7 wherein lugs are provided on said inner and outer sections of said nozzle ring and said sections are pulled apart by engagement with said lugs.

9. The method of improving the fatigue strength of control stage nozzles of an axial flow steam turbine as defined in claim 6 wherein said nozzle ring inner and outer sections are radially displaced relative to each other by heating the same and said nozzle block is cooled prior to insertion therebetween.

* * * * *